US005124901A

United States Patent [19]

Sojka et al.

[11] Patent Number: 5,124,901

[45] Date of Patent: Jun. 23, 1992

[54] SLOPING CEILING ADAPTER FOR RECESSED LIGHTING

[75] Inventors: Boris Sojka, Glendora; Raymond J. Kusmar, La Habra, both of Calif.

[73] Assignee: Thomas Industries Inc., Los Angeles, Calif.

[21] Appl. No.: 730,507

[22] Filed: Jul. 11, 1991

Related U.S. Application Data

[63] Continuation of Ser. No. 491,279, Mar. 9, 1990, abandoned.

[51] Int. Cl.[5] ..... F21S 1/06

[52] U.S. Cl. ..... 362/366; 362/148

[58] Field of Search ..... 362/147, 148, 364, 365, 362/366, 287, 427

[56] References Cited

U.S. PATENT DOCUMENTS

| | | | |
|---|---|---|---|
| 2,716,185 | 8/1955 | Burliuk et al. | 362/366 |
| 3,182,187 | 5/1965 | Gellert | 362/366 |
| 3,313,931 | 4/1967 | Klugman | 362/366 |
| 3,381,123 | 4/1968 | Docimo | 362/366 |
| 3,683,173 | 8/1972 | Guth, Jr. | 362/366 |
| 3,872,296 | 3/1975 | Cohen et al. | 362/366 |
| 4,729,080 | 3/1988 | Fremont et al. | 362/287 X |

OTHER PUBLICATIONS

Product Catalog "CapriDownlighting", cover and p. 32, 1988.

Product Catalog "CapriArchitectural", cover and p. 64, 1986.

Advertising publication entitled "Capri Architectural".

*Primary Examiner*—Stephen F. Husar

*Attorney, Agent, or Firm*—Hill, Van Santen, Steadman & Simpson

[57] ABSTRACT

An adapter for sloped ceilings or the like mounts a recessed lighting assembly in a ceiling at an angle to the ceiling surface. A lamp mounting sleeve is pivotable on the adapter frame and is fastenable in a plurality of angular positions by a strap extending between the mounting sleeve and the adapter frame. Mounting of the lighting assembly in the ceiling is accomplished by butterfly clips which permit the used of a variety of hanger bars and brackets.

20 Claims, 3 Drawing Sheets

FIG. 1
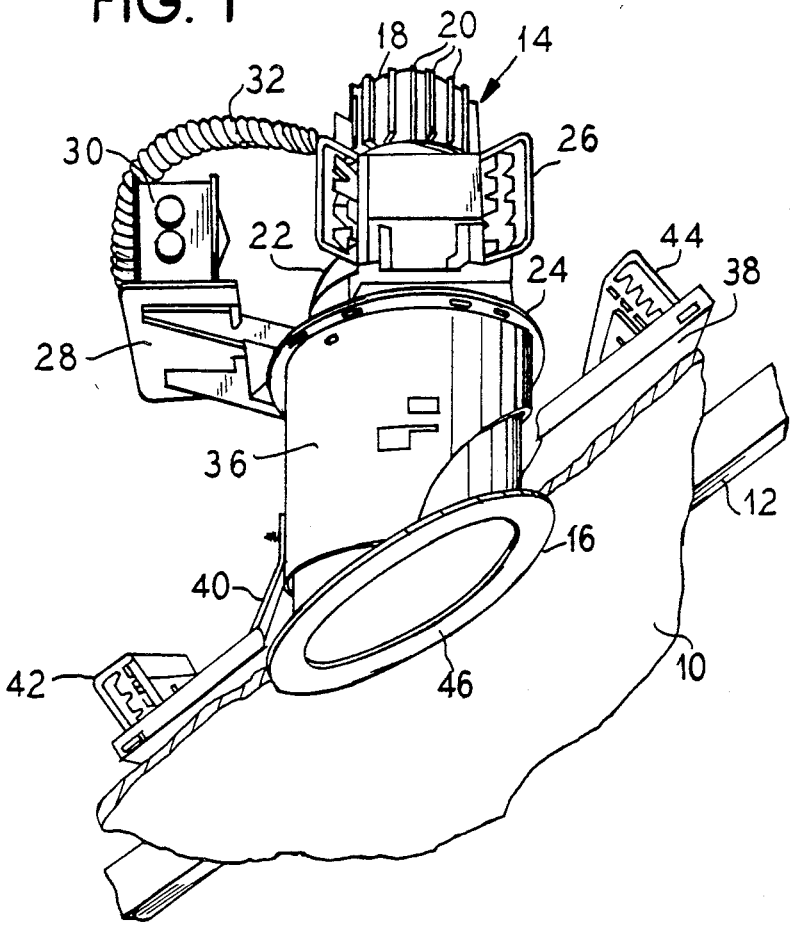
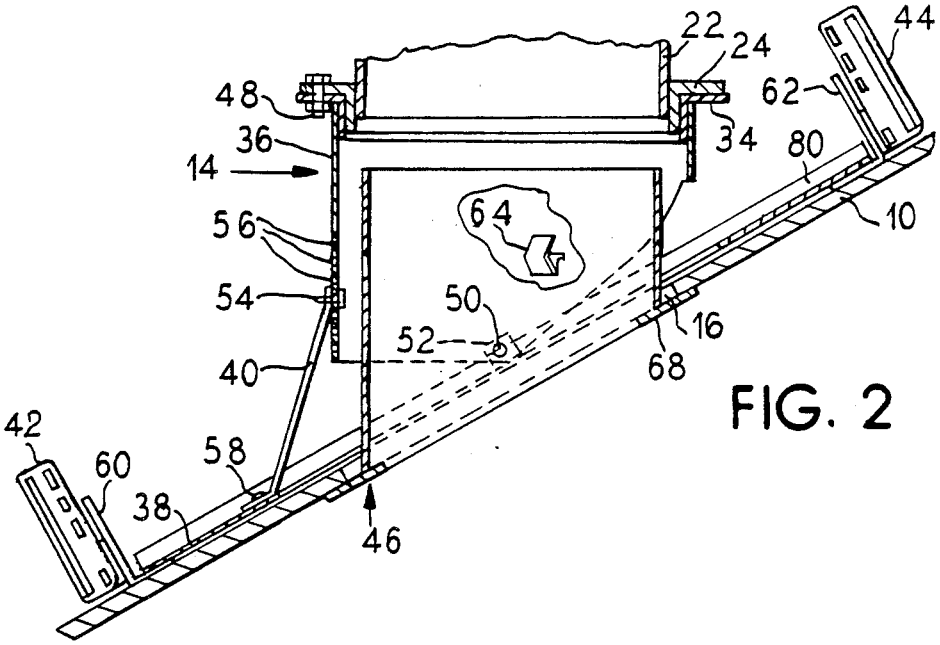
FIG. 2

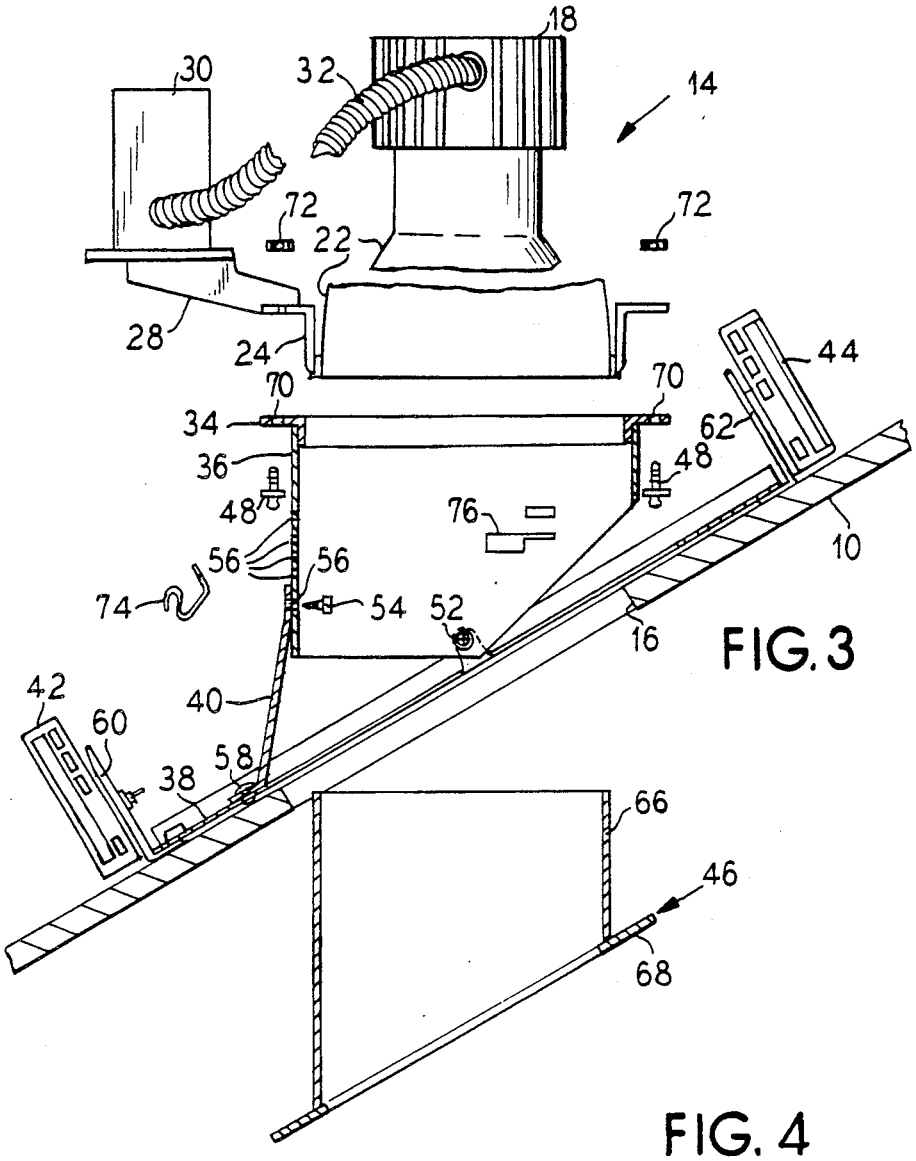
FIG. 3
FIG. 4
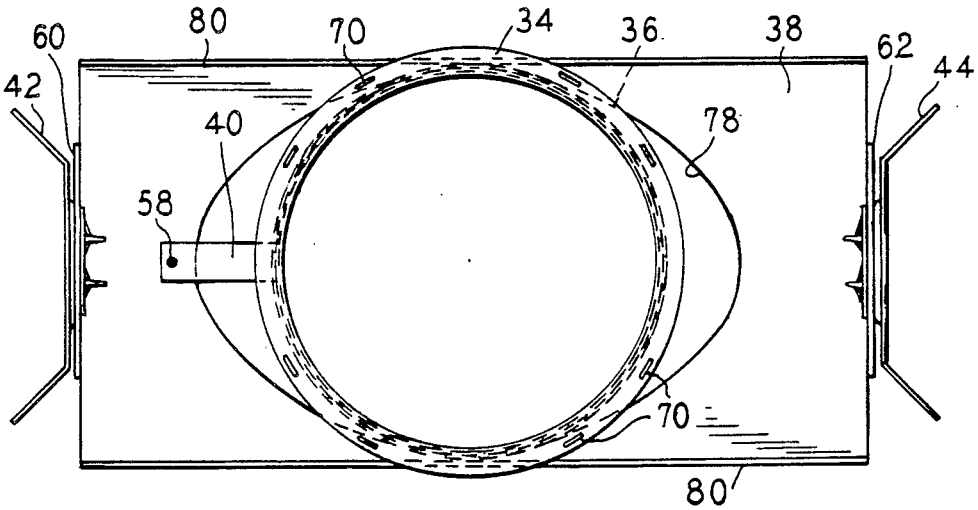

SLOPING CEILING ADAPTER FOR RECESSED LIGHTING

This is a continuation of application Ser. No. 491,279, filed Mar. 9, 1990, now abandoned.

BACKGROUND OF THE INVENTION

1. Field of the Invention

The present invention relates generally to a lighting fixture or frame for recessed lighting and, more particularly, to an adapter for a recessed lighting fixture for directing a light at an angle to a ceiling or other similar surface.

2. Description of the Related Art

Recessed lighting has become commonplace to meet the lighting requirements of various interior areas. Its use is not limited to interior areas, however, but may include exterior areas of buildings and the like as well. Recessed lighting typically includes a lamp housing mounted by brackets or frames within a ceiling or the like and directed to project light from the lamp through an aperture in the ceiling panel or other surface. The lamp housing is typically held in place in the ceiling by a type of bracket frequently referred to as a plaster frame, which may also include an electrical junction box within which wiring connections for the lamp are made.

Although most frequently mounted in horizontal ceilings, recessed lighting fixtures may also be mounted in a sloped ceiling in which the ceiling surface lies at an angle to horizontal. In sloped ceilings, recessed lighting provides an even more dramatic effect than in horizontal ceilings and it may be used not only for general lighting purposes but also to light, for example, architectural details.

For such sloped ceiling applications, a horizontal ceiling type lamp mounting frame with, for example, the lamp socket at an angle therein may be used if the ceiling is at a relatively shallow angle; or, on the other hand, a lighting fixture may be used which is specifically designed for use in sloped ceilings of a particular angle and is provided with an inclined surface at its lower end corresponding to the angle of the ceiling into which the fixture is to be mounted. An example of the latter such sloped ceiling recessed lighting fixture is disclosed in U.S. Pat. No. 4,729,080.

Typically, sloped ceiling fixtures are specially fabricated for each specific job, depending upon the slope angle of the ceiling. Such special orders require careful planning and exact advance information since such special orders may take lead times of 6 to 12 weeks from the order date to the date of delivery. Since the special orders are being made in limited quantities, they are considerably more expensive than standard fixtures and frames for horizontal ceilings, which are produced in quantity. On the other hand, any attempt to stock sloped ceiling fixtures requires quantities of fixtures for each possible ceiling slope angle, as well as for each different size and type of lighting fixture. Thus, costs are again higher due to storage requirements and other warehousing costs.

SUMMARY OF THE INVENTION

An object of the present invention is to vary the angle of a recessed lighting fixture to match different ceiling slope angles.

An object of the present invention is also to provide an inexpensive and simple lighting fixture for sloped ceiling recessed lighting.

Another object of the invention is to provide an off-the-shelf lighting frame for sloped ceiling recessed lighting fixtures which is simple and quick to use and reduces material and supply costs during construction.

A further object of the present invention is to provide a recessed lighting fixture which may be easily adjusted to direct light at a plurality of different angles in either sloped or horizontal ceilings and in which the angles are predetermined, are easily identified, and are easily set.

These and other objects and advantages of the invention are achieved in a slope adapter for recessed lighting fixtures formed of a rigid plate or frame having an elliptical aperture therein, and a mount or sleeve for a lamp housing or reflector mounted by pivot mounts over the elliptical aperture. The pivot mounts enable the lamp mounting sleeve to be pivoted about an angle relative to the plate. The slope adapter also includes means for fixing the mounting sleeve in a predetermined angular relationship relative to the rigid plate, the predetermined angular relationship preferably corresponding, at least approximately, to the angle of slope of the ceiling into which the slope adapter is to be mounted.

Of course, the slope adapter need not only be mounted in sloped ceilings. For example, the present device may be used to mount a recessed light at an angle in a horizontal ceiling. Also, although the lamp mounting sleeve is described hereinafter as being of cylindrical shape, other shapes are possible, such as to correspond to the shape of the lamp reflector. It may not be necessary in every instance for the opening in the plate to be elliptical, so long as the light from the recessed fixture is not obscured in any unwanted way.

In one embodiment, a pair of tabs extend out of the plane of the rigid plate on opposite sides of the elliptical aperture and engage, by a pivotable connection, a cylinder which forms the mount or sleeve for the lamp housing or reflector. The lower edge of the cylinder is cut at an acute angle relative to its axis on one side of the axis and is cut substantially perpendicular to its axis on the other side of its axis so that the cylinder may be tilted between a position perpendicular to the rigid plate and a position at an angle relative to the rigid plate without portions of the cylinder extending through the elliptical aperture. Thus, two faces are formed at the lower end of the cylinder, the two faces intersecting approximately at the axis of the cylinder.

To secure the cylinder or sleeve in a desired angular orientation, the means for fixing includes an elongated strap secured between the rigid plate generally along the long axis of the elliptical aperture and extending to a side wall of the sleeve. The end of the strap at either the sleeve or the plate may be removably fastened, while the other end of the strap is permanently fixed. To permit the angle of the sleeve relative to the plate or frame to be fixed at a plurality of positions, the removably fastened end of the strap may be secured at a plurality of locations.

In one embodiment, means are provided for fastening the strap to the side wall of the cylinder or sleeve at any of a plurality of locations. In a preferred embodiment, a series of openings are provided in a line along the side wall of the cylinder for selective registration with an opening in an end of the strap. Fastening of the opening in the strap in registration with one of the series of openings in the cylinder secures the cylinder or sleeve in an angular orientation relative to the rigid plate. To enable the angle of the sleeve to be predetermined, the holes in the series are each marked with the angle that results when the strap is fastened there. One such embodiment has the openings in the side wall of the cylinder at regularly spaced intervals which correspond to regularly spaced angles of the cylinder relative to the rigid plate, such as at every five degrees.

The mounting cylinder or sleeve for the lamp housing or reflector of a preferred embodiment includes a mounting flange at an end opposite the end pivotably mounted to the rigid plate by which the lamp housing may be affixed. Other means of affixing the lamp housings to the cylinder may also be provided. The rigid plate also includes means for affixing the slope adapter in position in a ceiling, including but not limited to mounting means and ways for accepting hangar bars or hangar straps and the like.

BRIEF DESCRIPTION OF THE DRAWINGS

FIG. 1 is a perspective view, generally from below, of a recessed lighting fixture mounted in a sloped ceiling using a slope adapter according to the principles of the present invention:

FIG. 2 is a vertical cross section through the present slope adapter of FIG. 1 shown mounted in a sloped ceiling;

FIG. 3 is an exploded, cross-sectional view of the recessed lighting fixture of FIG. 2 and showing the sloped ceiling adapter separated from a lamp housing and trim ring;

FIG. 4 is a plan view of the present slope adapter shown with the lamp mounting sleeve perpendicular to the frame or plate;

FIG. 6 is an elevational view of a fastening means for fastening the present slope ceiling adapter in position in a ceiling or the like.

DETAILED DESCRIPTION OF THE PREFERRED EMBODIMENTS

Figure 6:
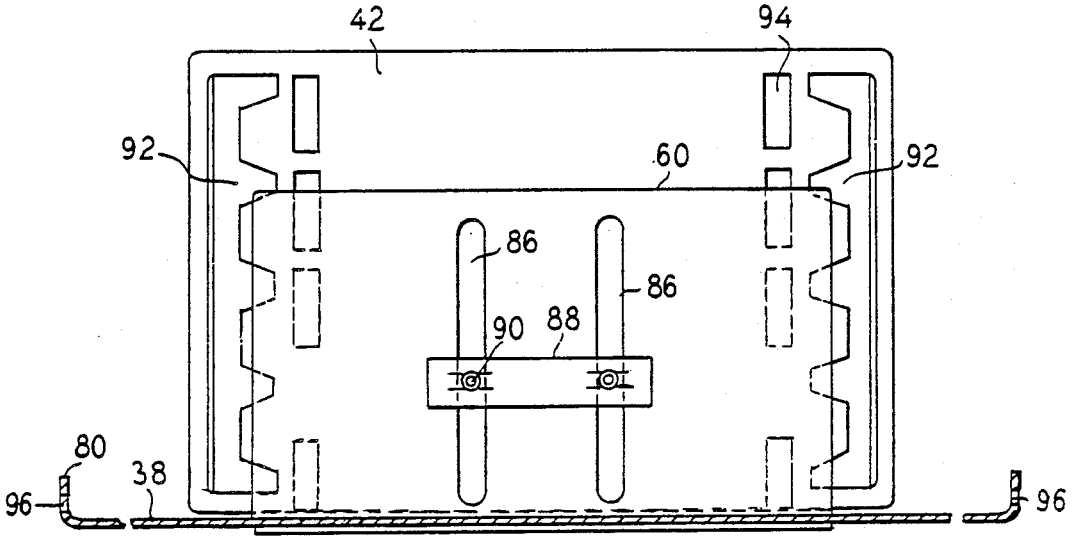

In FIG. 1 is shown a sloped ceiling panel 10, which may be either in an interior space, such as in a building, or may be under an overhang or the like outside of a building. The illustrated ceiling panel 10 lies at an angle to the horizontal, the particular angle depending upon architectural considerations. The ceiling panel 10 is supported by a plurality of generally regularly spaced ceiling joists 12. In the ceiling, in other words in a region above the ceiling panel 10, is mounted a recessed lighting fixture 14 holding a light bulb (not shown) mounted to direct light through an opening 16 in the ceiling panel 10. The lighting fixture 14 includes a socket cup 18 enclosing a socket (not shown) for the light bulb and having on its exterior surface a plurality of heat conducting fins 20 for cooling the lighting fixture 14. The socket cup 18 sits atop a reflector 22 which directs the light from the light bulb into a beam. The reflector 22 is mounted in a so called rough-in assembly 24 which includes a bracket for holding a butterfly clip 26 and a further bracket 28 supporting a junction box 30. Between the junction box 30 and the socket cup 18 extends an electrical conduit 32 that encloses electrical wiring that carries power to the light bulb. The electrical connections between a power main and the wiring within the conduit 32 is made within the junction box 30.

The rough-in assembly 24 is secured to a mounting ring 34 at the top end of a cylindrical lamp mounting sleeve 36. An opposite end of the lamp mounting sleeve 36 is pivotably mounted on a slope adapter frame or plate 38 that lies on or near the top surface of the ceiling panel 10. Extending between the frame or plate 38 and the lamp mounting sleeve 36 is an angle fixing strap 40. A pair of additional butterfly clips 42 and 44 are also provided on opposite ends of the plate 38. Lastly, a slope trim 46 is mounted in the ceiling opening 16 to provide a finished look to the recessed lighting fixture.

Further details of the invention can be seen in the cross section of FIG. 2, wherein the reflector 26 is seen mounted in the rough-in assembly 24, which in turn is affixed to the mounting ring 34 such as by thumb screws 48.

The lamp mounting sleeve 36 is attached to the slope adapter plate 38 by a fastener 50, such as a sheet metal screw, extending through a tab 52 on each side of the lower end of the mounting sleeve 36. A fastener 54, such as a sheet metal screw, extends through one of a plurality of adjustment openings 56 in the sleeve 36 and into a hole in the end of the angle retaining strap 40. An opposite end of the angle retaining strap 40 is secured on the adapter frame 38 by, for example, a rivet 58.

As can be seen, the butterfly brackets 42 and 44 are affixed to the adapter frame 38 by angle brackets 60 and 62, respectively, the angle brackets 60 and 62 being mounted at opposite ends of the frame 38. The slope trim 46 is held, in a centered position, in the lamp mounting sleeve 36 by a plurality of trim retaining clips 64. The slope trim 46 includes a cylindrical portion 66 that extends into the sleeve 36 for engagement by the clips 64 and an elliptical trim face 68 attached at a lower end thereof.

FIG. 3 shows an exploded view of the lighting fixture 14 in which the reflector 22 and rough-in assembly 24 are yet to be attached to the mounting ring 34 by the bolts 48, which are preferably thumb screws that extend through openings 70 in the mounting ring 34 and the rough-in assembly 2 for connecting to hex nuts 72.

The slope trim 48 is held in place within the lamp mounting sleeve 36 by three of the clips 64 which mount in clip mounting openings 76 in the sleeve 36. The clip mounting openings 76 have a lower clip insertion opening, along side of which is a clip retaining slot into which the clip 64 is slid after being inserted through the clip insertion opening. Above the clip retaining slot is a clip flexing clearance opening which permits the clip to flex without hitting the side of the sleeve.

In the plan view of FIG. 4, the lamp mounting sleeve 36 is shown perpendicular to the plane of the Figure and therefore is visible only in phantom beneath the mounting ring 34. The preferred embodiment of the lamp mounting sleeve 36 and mounting ring 34 is circular in cross section and is mounted above an elliptical opening 78 in the adapter frame 38. The adapter frame 38 of the preferred embodiment is of a generally planer sheet having upturned stiffening edges 80 at opposite sides thereof. As has been described above, the butterfly clips 42 and 44 are mounted by the angle brackets 60 and 62 at the opposite ends of the adapter frame 38.

Figure 5:
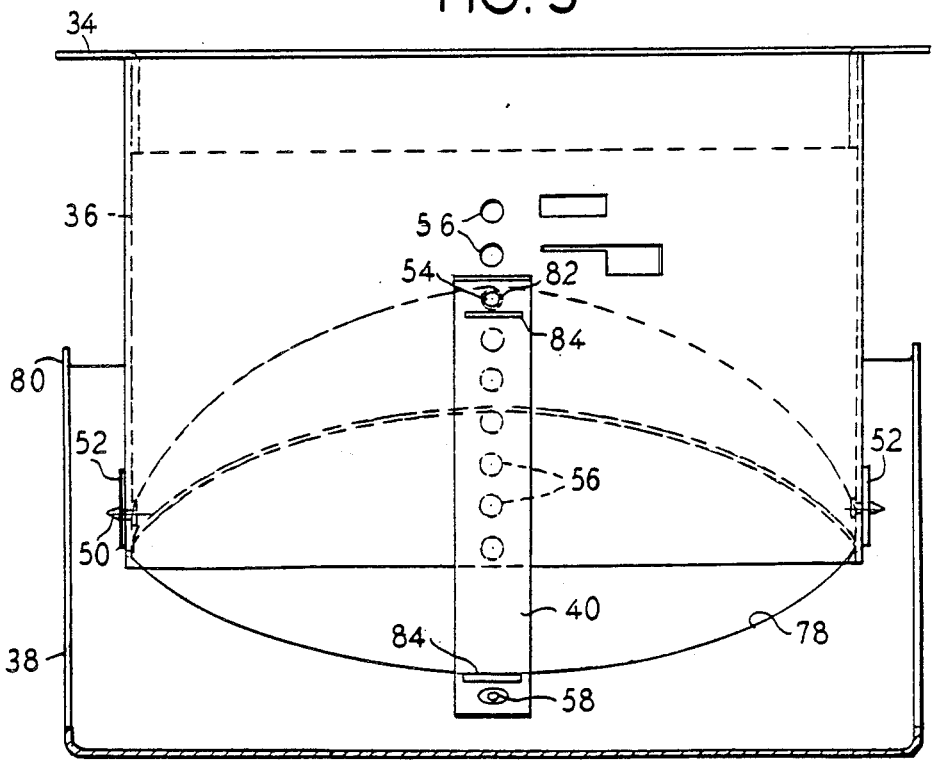
FIG. 5 is an enlarged elevational view of a means for fastening the present slope adapter in a plurality of predetermined angular positions.

FIG. 5 shows the preferred form of the means for holding the lamp mounting sleeve 36 at predetermined angular positions relative to the adapter frame 38. In particular, the tabs 52 are provided extending upwardly from the adapter frame 38 on either side of the elliptical opening 78. The lamp mounting sleeve 36 is mounted therebetween with the screw fasteners 50 extending through holes in the mounting sleeve 38 into the tabs 52. The end face of the mounting sleeve adjacent the adapter frame 38 is transverse to the axis of the cylindrical mounting sleeve 36 on one side of the pivot points and is cut at preferably a 45° angle to the axis of the cylindrical sleeve 36 on the other side of the pivot points. The sleeve 36 is thereby able to pivot between a perpendicular position normal to the adapter frame 38 and a position at approximately 45° to the adapter plate 38.

A series of holes 56 in the side of the mounting sleeve 36 extend along a line generally parallel to the axis of the sleeve and midway between the pivot points. The angle retaining strap 40 has a hole 82 in its free end for selective placement in registration with ones of the adjustment openings 56. The adjustment openings 56 are located at regular intervals along the mounting sleeve 3 which define regularly spaced predetermined angular positions of the mounting sleeve 36. In a preferred embodiment, the adjustment openings 56 are spaced so that the mounting sleeve 36 may be affixed at 5° intervals.

The angle retaining strap 40 as illustrated in FIG. 5 includes bending slots 84 adjacent either end thereof but preceding the attachment means for the ends of the strap 40.

In FIG. 6 is shown an end view of the adapter frame 38, including the stiffening edges 80, as well as the angle brackets 60 affixing the butterfly clip 42 to the adapter frame 38. A pair of parallel slots 86 and a fastener bar 88 through which a pair of adjustable fastening means, such as screws 90, extend enable the butterfly clip 42 to be selectively displaced vertically relative to the adapter frame 38. The butterfly clip includes a pair of openings 92 through which mounting brackets may be inserted and a plurality of smaller rectangular openings 94 through which hanger straps may be inserted. The hanger straps and brackets, which are well known in the art, are used to mount the lighting fixture 14 in place in the ceiling, such as between the rafters or ceiling joists. Slots 96 may also be provided in the stiffening edges 80 through which hanger bars may be inserted. The butterfly brackets, by the variety of openings provided therein and by the positional adjustability, provide a wide variety of mounting positions for the lighting fixture.

Thus, there is described and shown a lighting fixture for holding a recessed lighting assembly in a ceiling or the like at an angle to the ceiling surface. The slope adapter is angularly adjustable for a wide range of ceiling slopes.

Although other modifications and changes may be suggested by those skilled in the art, it is the intention of the inventors to embody within the patent warranted hereon all changes and modifications as reasonably and properly come within the scope of their contribution to the art.

We claim as our invention:

1. An adapter for mounting a recessed lighting fixture at an angle to a ceiling surface, comprising:

a generally cylindrical lamp mounting sleeve adapted to receive the recessed lighting fixture;

an adapter frame having an opening for mounting in registration with an opening in the ceiling surface, said adapter frame including a pair of pivot locations on either side of said of said opening, said pivot locations being pivotally connected to an end of said mounting sleeve so that said mounting sleeve is pivotable relative to said adapter frame about an axis extending through said pivot locations and through said end of said mounting sleeve; and means for selectively fixing said mounting sleeve at a predetermined angular relationship relative to said adapter frame.

2. An adapter as claimed in claim 1, wherein said means for fixing is a strap extending between said mounting sleeve and said adapter frame at a location remote from said pivot locations, said strap being fastenable at a plurality of locations on at least one of said mounting sleeve and said adapter frame.

3. An adapter as claimed in claim 1, wherein said end of said sleeve connected at said pivot locations is cut at an angle relative to an axis of said sleeve to accommodate various angular positions of the sleeve relative to the frame.

4. An adapter as claimed in claim 1, wherein said opening in said adapter is an elliptical opening.

5. An adapter as claimed in claim 2, further comprising:

a plurality of fastening locations on said sleeve lying in a line generally parallel to an axis of said mounting sleeve;

said strap being selectively fastenable at ones of said fastening locations.

6. An adapter as claimed in claim 5, wherein said fastening locations are substantially uniformly spaced along said mounting sleeve so that said mounting sleeve may be fixed at uniformly spaced angular positions.

7. An adapter as claimed in claim 1, wherein said adapter frame is a plate having an elliptical opening, said mounting sleeve being pivotably mounted in registration with said elliptical opening.

8. An adapter as claimed in claim 7, wherein said plate is substantially planar.

9. An adapter for mounting a recessed lighting fixture at an angle to a ceiling surface, comprising:

a generally cylindrical lamp mounting sleeve adapted to receive the recessed lighting fixture;

an adapter frame having an opening for mounting in registration with an opening in the ceiling surface, said adapter frame including a pair of pivot locations on either side of said of said opening, said pivot locations being pivotally connected to an end of said mounting sleeve so that said mounting sleeve is pivotable relative to said adapter frame;

means for selectively fixing said mounting sleeve at a predetermined angular relationship relative to said adapter frame;

said means for fixing being a strap extending between said mounting sleeve and said adapter frame at a location remote from said pivot locations, said strap being fastenable at a plurality of locations on at least one of said mounting sleeve and said adapter frame;

a plurality of fastening locations on a sleeve lying in a line generally parallel to an axis of said mounting sleeve;

said strap being selectively fastenable at ones of said fastening locations;

said fastening locations being holes, and means for fastening said straps in ones of said holes.

10. A slope adapter for mounting a recessed lighting fixture over an opening in a ceiling panel lying at an angle to horizontal, comprising:

an annular mounting ring adapted and constructed for connection to said recessed lighting fixture with light from the lighting fixture being directed through said mounting ring;

a cylindrical lamp mounting sleeve having a first end generally transverse to an axis of said mounting sleeve and a second end, said first end of said mounting sleeve being connected to said mounting ring, said second end of said mounting sleeve defining a first face lying generally transverse to said axis and a second face lying at an acute angle to said axis, said first and second faces intersecting approximately on said axis, said second face accommodating different angular positions of the sleeve relative to an adapter plate;

first and second pivot mounts on said second end of said mounting sleeve adjacent an intersection of said first and second faces;

an adapter plate having an elliptical opening with short and long axes;

means on said adapter plate for connecting said first and second pivot mounts to said adapted plate on said short axis for pivoting movement of said mounting sleeve in a direction of said long axis;

an elongated strap member connected between said mounting sleeve and adapter plate, said strap member being connected to said adapter plate generally in line with said long axis of said elliptical opening, said strap member being reconnectable at a plurality of locations on one of said mounting sleeve and said adapter plate; and means for mounting said adapter plate with said elliptical opening generally in registration with an opening in a ceiling panel.

11. A slope adapter as claimed in claim 10, wherein said means for connecting comprises:

first and second tabs on said adapter plate at opposite sides of said elliptical opening generally on said short axis;

said first and second pivot mounts being connected to said first and second tabs.

12. A slope adapter as claimed in claim 10, wherein said strap member has a first end fixed to said adapter plate and a second end removably connectable at a plurality of locations on said mounting sleeve.

13. A slope adapter as claimed in claim 10, wherein said means for mounting comprises:

butterfly clips mounted at opposite ends of said adapter plate generally in line with said long axis of said elliptical opening, said butterfly clips defining a plurality of openings for accepting support bars and the like.

14. A slope adapter as claimed in claim 13, further comprising:

angle brackets connected between said butterfly clips and said adapter plate, said butterfly clips being adjustable relative to said angle brackets.

15. A slope adapter as claimed in claim 10, further comprising:

trim mounting clips connected at an inside surface of said mounting sleeve.

16. A slope adapter for mounting a recessed lighting fixture over an opening in a ceiling panel lying at an angle to horizontal, comprising:

an annular mounting ring adapted and constructed for connection to said recessed lighting fixture with light from the lighting fixture being directed through said mounting ring;

a cylindrical lamp mounting sleeve having a first end generally transverse to an axis of said mounting sleeve and a second end, said first end of said mounting sleeve being connected to said mounting ring, said second end of said mounting sleeve defining a first face lying generally transverse to said axis and a second face lying at an acute angle to said axis, said first and second faces intersecting approximately on said axis;

first and second pivot mounts on said second end of said mounting sleeve adjacent an intersection of said first and second faces;

an adapter plate having an elliptical opening with short and long axes;

means on said adapter plate for connecting said first and second pivot mounts to said adapter plate on said short axis for pivoting movement of said mounting sleeve in a direction of said long axis;

an elongated strap member connected between said mounting sleeve and adapter plate, said strap member being connected to said adapter plate generally in line with said long axis of said elliptical opening, said strap member being reconnectable at a plurality of locations on one of said mounting sleeve and said adapter plate; and means for mounting said adapter plate with said elliptical opening generally in registration with an opening in a ceiling panel;

said strap member has a first end fixed to said adapter plate and a second end removably connectable at a plurality of locations on said mounting sleeve;

an arrangement of connecting holes in a line along said mounting sleeve generally parallel to said axis of said sleeve; and means for removably connecting said second end of said strap member at ones of said connecting holes.

17. A slope adapter as claimed in claim 16, wherein said means for removably connecting is selectively connectable to ones of said connecting holes by access through said elliptical opening in said adapter plate.

18. A slope adapter for mounting a recessed lighting fixture over an opening in a ceiling panel lying at an angle to horizontal, comprising:

an annular mounting ring having an annular flange lying in a plane, said annular flange defining a plurality of light fixture connection holes by which a lighting fixture is mounted to said mounting ring;

a cylindrical lamp mounting sleeve having a first end connected to said mounting ring, said mounting sleeve being of approximately of the same diameter as said mounting ring, said mounting sleeve having a second end opposite said first end, said second end defining a first end face substantially perpendicular to an axis of said cylindrical mounting sleeve and a second face at an angle of approximately 45° to said axis, said first and second faces intersecting approximately on said axis;

an adapter plate having an elliptical opening with a short axis and a long axis, said short axis being approximately equal to a diameter of said mounting sleeve;

a pair of tabs on said adapter plate generally at opposite ends of said short axis of said elliptical opening, said tabs being substantially perpendicular to said adapter plate, pivot means for pivotably connecting said tabs at opposite sides of said mounting sleeve adjacent said second end, said pivot means being adjacent an intersection of said first and second faces;

a strap having a first end connected to said adapter plate adjacent an end of said long axis of said elliptical opening, said strap having a second end defining a first connecting hole, said second end being positionable adjacent a side of said mounting sleeve;

said mounting sleeve defining a plurality of second connecting holes lying in a line substantially parallel to said axis of said mounting sleeve, said second connecting holes being at regularly spaced intervals from on another; and a threaded connecter selectively connectable in ones of said second connecting holes and simultaneously in said first connecting hole to secure said second end of said strap at one of a plurality of positions on said mounting sleeve to retain said mounting sleeve in one of a plurality of available angular positions relative to said adapter plate.

19. A slope adapter as claimed in claim 18, further comprising:

bent up edges along opposite edges of said adapter plate, said bent up edges being transverse to said short axis of said elliptical opening.

20. A slope adapter as claimed in claim 18, further comprising:

trim mounting clips mounted at a plurality of locations within said mounting sleeve.

* * * * *